US005906404A

United States Patent [19]

McGhee

[11] Patent Number: 5,906,404

[45] Date of Patent: May 25, 1999

[54] LATCH SOCKET FOR REINFORCING THE LOCK BETWEEN A DOOR AND A DOOR FRAME

[76] Inventor: John D. McGhee, 2414 Pine Crest La., Fredericksburg, Va. 22403

[21] Appl. No.: 08/995,877

[22] Filed: Dec. 22, 1997

[51] Int. Cl.[6] ..... E05B 15/02

[52] U.S. Cl. ..... 292/340; 292/341.18

[58] Field of Search ..... 292/340, 251, 292/341.18; 411/389, 393, 395, 403, 404

[56] References Cited

U.S. PATENT DOCUMENTS

| | | | |
|---|---|---|---|
| Re. 31,276 | 6/1983 | Schlage . | |
| 381,792 | 4/1888 | Jones | 292/340 |
| 948,598 | 2/1910 | Stuart | 292/340 |
| 1,075,710 | 10/1913 | Goodwin | 411/393 |
| 1,091,453 | 3/1914 | Fletcher . | |
| 1,853,456 | 4/1932 | Ross . | |
| 2,229,565 | 1/1941 | Halowell, Jr. | 411/403 |
| 2,272,241 | 2/1942 | Fendring | 292/340 |
| 2,370,781 | 3/1945 | Cullum . | |
| 2,830,635 | 4/1958 | Thorstens | 411/393 |
| 4,005,890 | 2/1977 | Murch . | |
| 4,186,954 | 2/1980 | Detlefs | 292/340 |
| 4,211,442 | 7/1980 | Hansen | 292/145 |
| 4,550,939 | 11/1985 | Babb, Jr. et al. . | |
| 4,865,370 | 9/1989 | Francis . | |
| 4,872,717 | 10/1989 | McEvoy et al. . | |
| 5,024,475 | 6/1991 | Francis . | |
| 5,570,917 | 11/1996 | Cutrer . | |
| 5,593,194 | 1/1997 | Liau | 292/340 |
| 5,769,473 | 6/1998 | Sovis | 292/340 |

FOREIGN PATENT DOCUMENTS

| | | | |
|---|---|---|---|
| 047917 | 1/1976 | United Kingdom | 292/251 |

*Primary Examiner*—Steven Meyers
*Assistant Examiner*—Stephen Grady
*Attorney, Agent, or Firm*—Diller, Ramik & Wight,PC

[57] ABSTRACT

A latch socket is provided for reinforcing the lock achieved between the door and a door frame utilizing a deadbolt lock or a key lock. The latch socket includes a relatively rigid elongated metallic one-piece homogeneous cast metal member having an exterior cylindrical surface with a coarse thread cast therein which is adapted to be threaded into a relatively large diameter drill hole of an associated door frame. The member includes opposite tubular end portions with a wall therebetween having a socket for receiving a drive tool for imparting axial and rotational drive force to the member for threading the same into or unthreading the same from an associated door frame drill hole.

2 Claims, 2 Drawing Sheets

LATCH SOCKET FOR REINFORCING THE LOCK BETWEEN A DOOR AND A DOOR FRAME

BACKGROUND OF THE INVENTION

A conventional door frame generally includes a pair of 2"×4" studs nailed together to form a door passageway which is faced-off with a ¾" face board of pine or similar material. A door is hinged to one side of the door frame, and an opposite edge of the door carries a conventional door key lock and a deadbolt lock, and the latch of each of these moves into and out of a 1" hole drilled into the face board and a portion of the adjacent 2"×4" stud of the door frame. Typically, a flat latch plate having a latch opening is connected by a pair of short metal screws in overlying relationship with each of the door frame drill holes. However, deadbolt locks/latches and key locks/latches project only minimal distances through the holes of their respective latch plates and into the drill holes of the face plate or face board and the door frame stud(s). One can virtually shatter the ¾" face board by kicking the door in the area of the latch(es) and, not uncommonly, most break-ins through doors occur in this simplistic manner.

Secondary latching devices, such as chains and sliding bolts, have also been utilized in conjunction with door key locks and door deadbolt locks, but these also are fastened by short screws to the ¾" door frame face board, and the penetration of the screws into the 2"×4" stud/frame is minimal.

U.S. Pat. No. 5,570,917 issued on Nov. 5, 1996 to Cutrer is an effort at reinforcing a door lock/latch and/or deadbolt lock/latch through first recognizing that a door casing and/or the face board are the weakest points thereof. Rod members are provided that extend into the wall interior structure enabling the wall interior structure to be reinforced and strengthened thereby. However, the so-called reinforced door latch striker plate and deadbolt striker plate are expensive, relatively speaking, to manufacture and install.

Other prior art patents which attempt to avoid/eliminate door break-ins through the utilization of specially formed reinforced sockets, longer screws, auxiliary reinforcement members, etc. include structures of the type disclosed in the following patents representative of the prior art in this area:

U.S. Pat. No. RE 31,276
U.S. Pat. No. 1,091,453
U.S. Pat. No. 1,853,456
U.S. Pat. No. 2,370,781
U.S. Pat. No. 4,005,890
U.S. Pat. No. 4,550,939
U.S. Pat. No. 4,865,370
U.S. Pat. No. 4,872,717
U.S. Pat. No. 5,024,475

SUMMARY OF THE INVENTION

In accordance with the foregoing, a primary object of the present invention is to provide a novel latch socket for reinforcing the lock between a door and a door frame utilizing either a deadbolt and/or a key lock by providing a relatively rigid elongated metallic reinforcement member having an exterior cylindrical surface with an exterior relatively coarse thread adapted to be threaded into a relatively large diameter (1") drill hole of an associated door frame. A socket for a drive tool is located centrally or axially of the member for imparting axial and rotational driving force thereto for threading the member into an associated door frame drill hole. The latch socket is thus relatively inexpensive to manufacture by virtue of a single casting operation and can be readily, quickly and easily installed by simply drilling a hole in the door assembly/frame and threading the latch socket into the door frame drill hole or bore.

The latch socket can also include a radially outwardly directed flange which would eliminate the need for a latch plate or cover plate, though in keeping with the present invention, a conventional latch plate can be placed into overlying relationship to the latch socket in a conventional manner.

The latch socket preferably includes axially opposite tubular open end portions with a wall therebetween, and the wall includes the drive socket for a drive tool, such as an Allen wrench.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
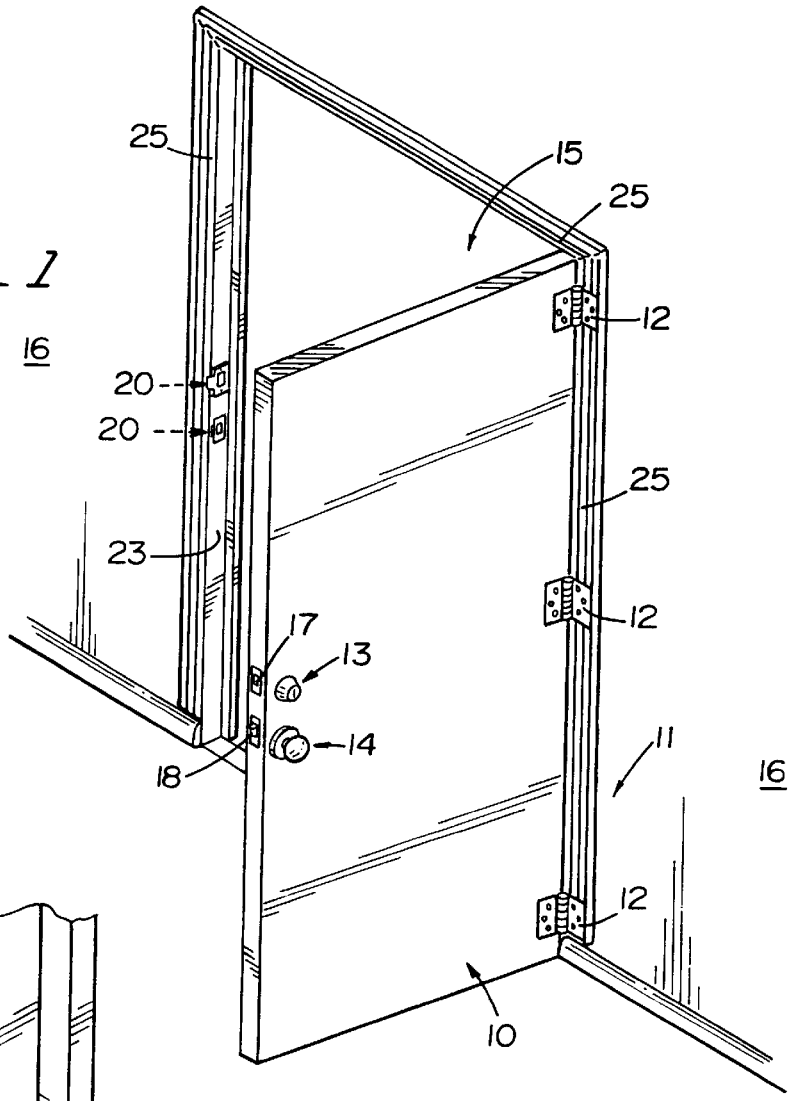
FIG. 1 is a perspective view of a door frame/door assembly, and illustrates a door hinge to the door frame, and a key latch and a deadbolt latch carried by the door for latching engagement with latch sockets of the present invention threaded in drill holes of the frame.
Figure 2:
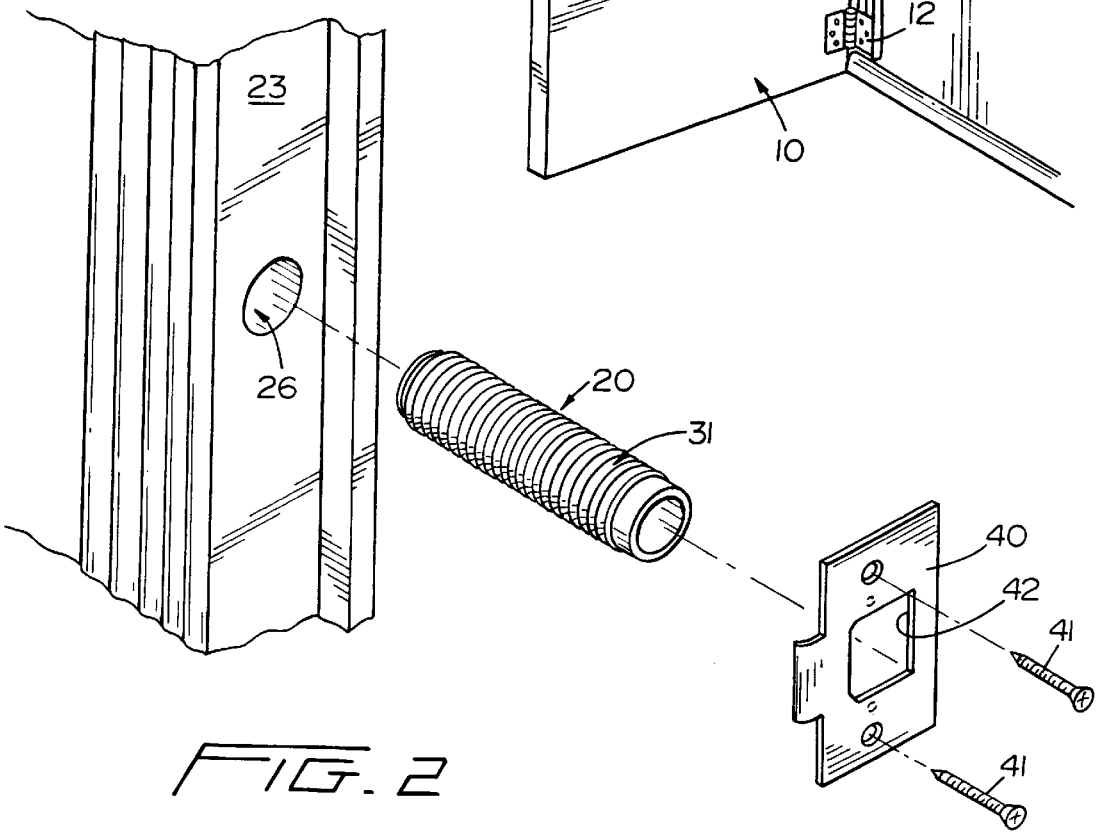
FIG. 2 is an enlarged fragmentary perspective view of a portion of the door frame/door assembly, and illustrates a bore therein, a generally tubular metallic latch socket of the invention having an exterior thread, and a conventional latch plate and its associated wood screws.
Figure 3:
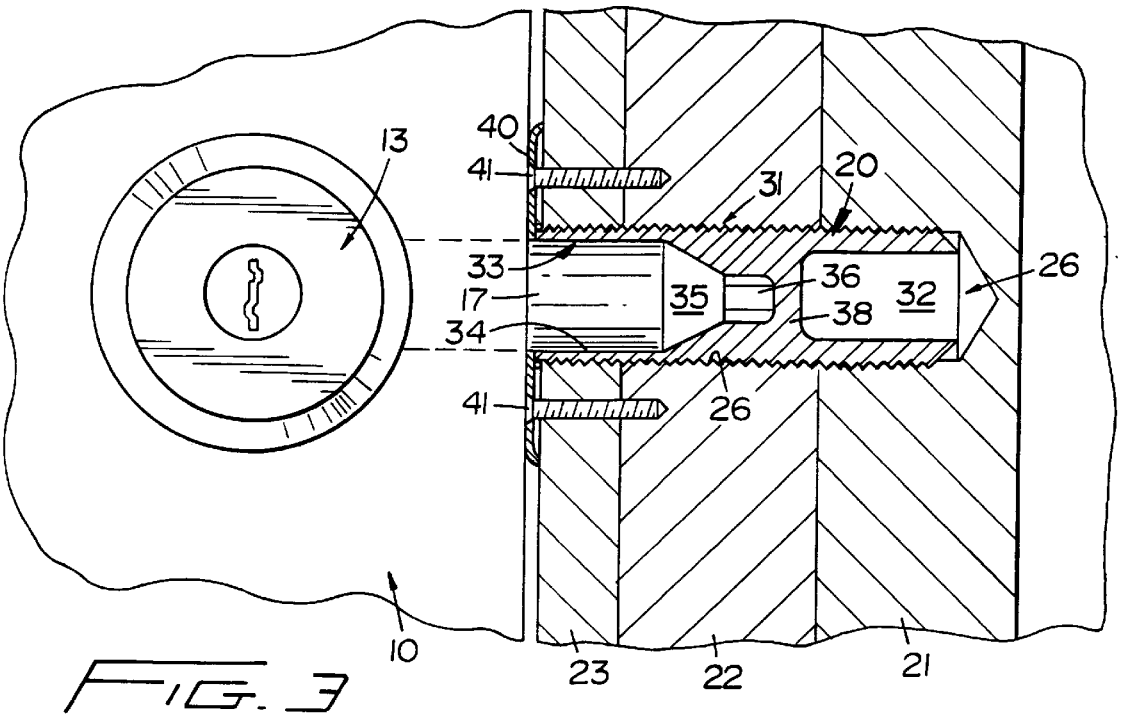
FIG. 3 is an enlarged fragmentary cross-sectional view taken vertically through the door assembly/door frame of FIG. 1 with the door in its closed and latched position, and illustrates the latch socket threaded into the door frame and a latch of the key lock in its locked position within a tubular end portion of the latch socket and a separate face plate connected to the face board of the door frame.
Figure 4:
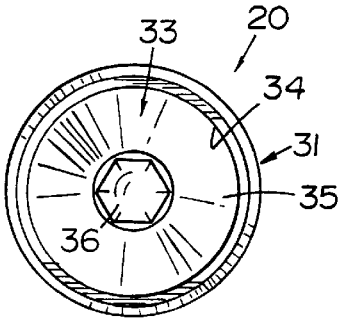
FIG. 4 is an axial view of the latch socket looking from left-to-right in FIGS. 3 and 5, and illustrates the hexagonal configuration of a drive socket thereof.

A conventional door 10, a door frame or door assembly 11, associated identical hinges 12, a key latch 13 and a deadbolt latch 14 are illustrated in FIG. 1 of the drawings associated with a passage 15 in a conventional wall 16. The key latch or key lock 13 and the deadbolt latch or deadbolt lock 14 are each of a conventional construction, and each includes respective latching tongues 17, 18. The latching tongues 17, 18 of the key latch and the deadbolt latch 14, respectively, are designed to enter into identical latch sockets 20 of the present invention set in the door frame The latch socket 20 (FIGS. 2 through 4) is specifically adapted to reinforce the lock achieved between the conventional door 10 and the conventional door frame 11 which conventionally includes two 2"×4" studs 21, 22 (FIG. 3) nailed together and to the face of which is nailed a ¾" face board 23 (FIG. 3). Conventional trim boards or molding 25 (FIG. 1) can be utilized to provide necessary aesthetics, but from a utilitarian standpoint, a 1" diameter blind bore 26 (FIG. 2) is drilled through the face board 23 into and through the first 2"×4" stud 22 and into but not necessarily through the second or innermost 2"×4" stud 21 (FIG. 3). It is into the bore or drill hole 26 that the latch socket 20 is threaded, as will be described more fully hereinafter.

The latch socket 20 is preferably a one-piece, homogeneous, metallic member preferably made from cast metallic material, such as brass. The latch socket 20 is a relatively rigid elongated member having an exterior cylindrical surface carrying a relatively large coarse thread 31 which is adapted to be threaded into and "bite" relatively deeply radially into the bore 26 of the associated door frame 11.

Figure 5:
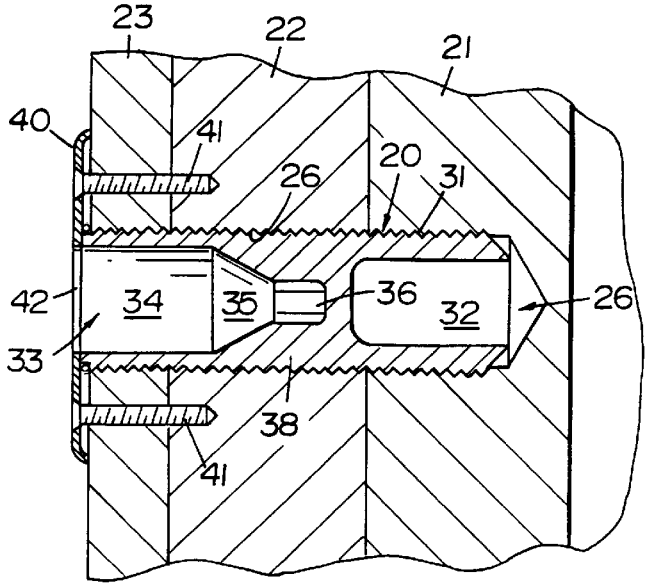
FIG. 5 is a fragmentary cross-sectional view of the latch socket of FIG. 3, but illustrates the same absent the latched condition of the door.

The latch socket 20 includes opposite generally tubular axially oppositely opening end portions or cavities 32, 33 (FIG. 5). The cavity 33 includes a cylindrical cavity portion or surface 34 merging with a frusto-conical surface portion 35 which in turn blends with means 36 in the form of a socket for removably connecting a drive tool, such as an Allen wrench, to the latch socket 20 for applying an axial and rotational drive force thereto for threading the latch member 20 into the drill hole 26 (and removing the same therefrom). The frusto-conical surface 35 and the drive socket 36 are cast in an intermediate wall 38 which defines a blind end of both the drive socket 36 and the cavity 32. Though the socket 36 is preferably hexagonal, as is illustrated best in FIG. 4, other configurations might be utilized, such as a single slot into which might be inserted the blade of a conventional screw driver.

In order to secure the latch socket 20 to the frame 11, the bore 26 is conventionally drilled by utilizing a 1" drill bit associated with a power drill. The latch socket 20 is then aligned with the bore 26 and can be initially hand-threaded into the portion of the bore 26 formed in the relatively soft (pine) material of the face board 23. The drive tool (not shown), such as an Allen wrench, can be utilized conventionally by inserting one of its hexagonal ends in the drive socket 36 and rotating/threading the latch socket 20 into the drill hole or blind bore 26, as is illustrated in FIGS. 3 and 5. The key latch 13 can be operated conventionally by utilizing a key to move the latch tongue 17 into the cylindrical portion 34 of the latch socket 20 for latching/locking purposes (FIG. 3). Since the latch socket 20 is relatively long and strong and is externally threaded into binding intimate securement with the relatively hard/strong 2"×4" studs 21, 22, breakage of the door 10/door frame 11 and the associated latches (13, 14) by kicking the same presents an extremely difficult proposition. However, should damage occur, the withdrawal/unthreading repair and reassembly of the latch socket 20 can be readily achieved.

A conventional latch plate or face plate 40 can be utilized with the latch socket 20 by simply securing the same to the door frame 11 utilizing short wood screws 41 which hold the face plate 40 with its opening 42 generally axially aligned with the axis (not shown) of the latch socket 20 (FIGS. 3 and 5). The face plate 40 is simply provided for aesthetic purposes but offers relatively little rigidity/reinforcement to the overall assembly.

Figure 6:
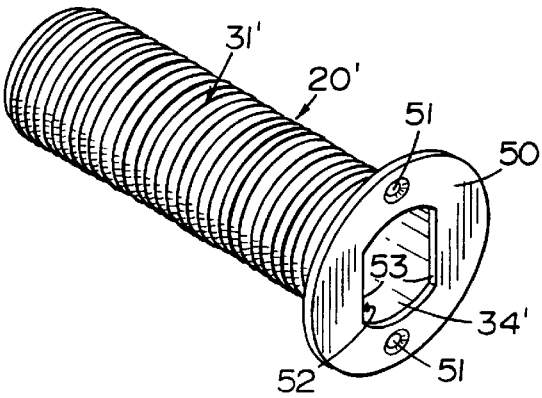
FIG. 6 is a perspective view of another latch socket of the invention, and illustrates a latch socket similar to that of FIGS. 2 through 5 but having an integral radially outwardly directed peripheral flange.

In lieu of a separate face plate, another latch socket 20' of FIG. 6 is provided with identical, though primed reference numerals, which identify structure corresponding to that of the latch plate 20 of FIGS. 2 through 5 of the drawings. The latch socket 20' is similarly a substantially homogeneous one-piece cast metallic member having axially opposite cavities, of which only the cavity 34' is illustrated and between which is a blind wall corresponding to the wall 38 including a drive socket 36 therein. The latch socket 20' further includes an exterior thread 31' and additionally a radially outwardly directed integral flange 50 having diametrically opposite holes 51 and an opening 52 which includes diametrically opposite generally parallel flat edges 53. The flat edges 53 are intended to be positioned generally vertically when the latch member 20' is threaded into a bore 26 and is prevented from rotating by wood screws passing through the openings 51 in much the manner shown in FIGS. 3 and 5 with respect to the wood screws 41. The vertical edges 52 are designed to cooperate with and bear against like substantially flat edges (not shown) of associated latching tongues 17, 18. Thus, in keeping with the embodiment of the latch socket 20' of FIG. 6, the separate face plate 40 of FIGS. 3 and 5 need not be utilized, but upon threading the latch socket 20' into a blind drill bore 26 of a door frame 11, the orientation must be such that the edges 53, 53 are disposed generally vertically.

Although a preferred embodiment of the invention has been specifically illustrated and described herein, it is to be understood that minor variations may be made in the apparatus without departing from the spirit and scope of the invention, as defined the appended claims.

I claim:

1. The combination of a door, a door frame, a latch tongue and a latch socket comprising a relatively large diameter drill hole in said door frame aligned with said latched tongue in a relatively closed position of said door and door frame, said latch socket being a relatively rigid elongated metallic member having an exterior cylindrical surface extending between opposite ends thereof, a thread along substantially the entire exterior cylindrical surface between the ends thereof and being threaded into said relatively large diameter drill hole of said door frame, means for removably connecting a drive tool to said member for applying an axial and rotational drive force to said member for threading said member into said relatively large diameter door frame drill hole; said member being a substantially one-piece, homogeneous, metallic material; axially opposite end portions of said member being tubular and defining therebetween a blind end wall, and said drive connecting means being located in one of said tubular end portions.

2. The combination as defined in claim 1 wherein said one tubular end portion is defined at least in part by a surface of said blind wall, and said drive connecting means is a drive socket disposed in said blind wall surface.

* * * * *